United States Patent [19]

Walton et al.

[11] Patent Number: 4,630,694

[45] Date of Patent: Dec. 23, 1986

[54] INTEGRAL BLADE HOLE OPENER

[76] Inventors: Paul G. Walton, 211 Hamner Dr., Houma, La. 70364; Percy A. Little, 5825 Cherokee La., Alexandria, La. 71301

[21] Appl. No.: 788,011

[22] Filed: Oct. 16, 1985

[51] Int. Cl.[4] ..... E21B 10/26

[52] U.S. Cl. ..... 175/391; 175/325; 175/406; 175/408; 408/82; 408/225

[58] Field of Search ..... 175/406, 325, 385, 391, 175/327, 409, 401, 408; 408/79-82, 223-225, 227-229, 213

[56] References Cited

U.S. PATENT DOCUMENTS

| | | | |
|---|---|---|---|
| 1,701,427 | 2/1929 | Shields | 408/224 |
| 2,084,421 | 6/1937 | Wright | 175/406 |
| 3,106,766 | 10/1963 | Chadderdon | 408/227 |
| 3,147,536 | 9/1964 | Lamphere | 175/406 |
| 3,645,587 | 2/1972 | Parker | 175/323 |
| 4,091,523 | 5/1978 | Karasiewicz et al. | 408/82 |

FOREIGN PATENT DOCUMENTS

| | | | |
|---|---|---|---|
| 1249499 | 11/1960 | France | 175/385 |
| 791729 | 3/1958 | United Kingdom | 175/406 |

*Primary Examiner*—James A. Leppink
*Assistant Examiner*—Hoang C. Dang
*Attorney, Agent, or Firm*—Pravel, Gambrell, Hewitt & Kimball

[57] ABSTRACT

A hole opener for placement in a drill string having a body generally comprising a collar, a triangular mid-section, a triangular shaped pilot and a bull nose. The collar provides means for attaching the tool body to the drill string. The triangular mid-section has three longitudinal, radially spaced apart blade members that are parallel to the central axis of the tool body so that the blades can cut into the walls of the bore hole to enlarge the size of the bore hole. Three annular flow zones span the distance between the blade members so that fluids and cuttings can circulate through the bore hole. The pilot section also has three longitudinal, radially spaced apart blade members that are parallel to the central axis of the tool body bore and three annular flow zones which span the distance between the blade members of the pilot. The pilot section is downhole from the mid-section. The outer diameter of the blades of the pilot section are substantially less than the outer diameter of the blades of the mid-section, thus allowing the hole to be enlarged gradually. A bull nose downhole of the pilot section and of an outer diameter somewhat less than the inner diameter of the bore hole guides the drill string through the bore hole. The collar, mid-section, pilot section and bull nose are integral portions of the tool body.

10 Claims, 5 Drawing Figures

INTEGRAL BLADE HOLE OPENER

BACKGROUND OF THE INVENTION

1. Field of the Invention

The present invention relates to an improved device for enlarging the size of existing oil and gas well bore holes.

2. General Background

When drilling oil and gas wells, it is sometimes desirable to enlarge the size of the existing bore hole. "Hole openers", as the name applies, are used for this purpose. Hole openers are run at the end of a drill string, in place of the drill bit. Typically, hole openers have three primary parts, i.e., (1) the tool body, (2) blade members such as cutters, and (3) the bull nose. The tool body can be cylindrical having an internal bore and has blade members arranged around the exterior of the cylindrical body so that the outer diameter of the tool is larger than the inner diameter of the existing "hole" or well bore. A bull nose, usually affixed to the tool body by standard threaded connections, has an outer diameter somewhat smaller than the inner diameter of the bore hole. The bull nose serves as a guide to align and stabilize the tool body in the bore hole while the blade members are increasing the size of the hole. Blade members such as cutters are commonly affixed to the tool body by welding or by removable pins. A hole opener is usually removably attached to a drill string by means of standard A.P.I. pin and box connectors at the end of the tool opposite the bull nose.

Hole openers are related to other oil and gas well drilling tools such as mills, reamers, and to a lesser degree, stabilizers. Hole openers can differ from these tools in design, function, and position on a drill string. For example, reamers and stabilizers are usually run on a drill string in conjunction with a drill bit, whereas hole openers and mills are run in place of a drill bit. While hole openers are used to enlarge an existing bore hole, mills are used to grind up debris in the bore hole, to remove stuck portions of drill stem or sections of casing for sidetracking and to ream out tight spots in the casing. Reamers are used to smooth out the wall of the well, to help stabilize the bit, to straighten the bore hole if it "doglegs", to drill directionally, and to enlarge the bore hole to a specified size. Stabilizers are used to either change the deviation angle in a well or to maintain the correct hole angle.

Features common to hole openers, mills, reamers and stabilizers are blade members, annular flow zones and circulation jets. The annular flow zones generally span the distance between the blade members so that fluid can circulate in the bore hole during drilling operation. Circulation jets in the tools allow fluids to flow out of the internal bore of the tool body and into the well bore, to remove cuttings from the well bore to the surface, and to maintain the hydrostatic pressure in the well.

There are two problems typically associated with the operation of hole openers. These two problems are often found in the operation of reamers, mills and stabilizers as well. These problems are the loss of blades in the hole and the "balling up" of blades with shale cuttings. Blades are commonly affixed to the tool body by means of pins or welds. The extreme pressures encountered in drilling operations weaken the connections and cause the blade to break away from the tool body. It is sometimes necessary to remove the drill string from the hole and use a fishing tool to retrieve the blade. Fishing for these broken blades can be a time-consuming and costly operation.

In soft, unconsolidated formations such as the gumbo shale found in the Gulf of Mexico, tools having limited area annular flow zones between the blades that become "balled-up" with cuttings. Once the blades are "balled-up", the tool loses its effectiveness. Additionally, as a balled-up tool is removed from the well bore, it may prevent drilling fluids from circulating along the length of the bore hole. The hydrostatic pressure in the hole may then become unequalized and a kick or blowout condition may result.

Hole openers, mills, reamers and stabilizers of various designs are commercially available. Representative of the hole openers available are those of Security, a division of Dresser Industries. These hole openers have integral bodies, interchangeable cutters and circulation jets. Security's hole openers do not have three longitudinally, radially spaced apart blades that are parallel to the central axis of the tool body. Nor do the Security hole openers have three annular flow zones that span the distance between the blade members.

Eastman Oil Well Survey Company has an "Eastco" two cutter hole opener. The entire body is cast from a single piece of steel, gut it has roller cutters which are secured to the tool body by pins or bolts. Roller cutters are susceptible to balling up in soft formations. The bull nose is solid, i.e., it does not have an internal bore through which fluids can be circulated.

American Iron and Machine Works, Inc. has a roller reamer that may be converted into a hole opener by replacing the reamer blades with cutter blades. The blades are affixed by pins and are susceptible to being lost in the hole. The pilot section of this tool appears to be in a "fish-tail" configuration. A pilot so designed will cause an existing well bore to become sidetracked if the fishtail digs into the wall of the well bore. Sidetracking occurs frequently in soft unconsolidated formations and in directional wells.

Parko, Inc. is the assignee of U.S. patent application Ser. No. 702,647 filed Feb. 14, 1985 for a reamer having three longitudinal, radially spaced apart blade members that are parallel to the central axis of the tool body. The blades are an integral portion of the tool body. The Parko reamer does not have a pilot and a bull nose. The blade members of the Parko reamer do not converge with the annular flow zone to form a channel means to receive and sweep away cuttings from the blade members as the size of the bore hole is enlarged.

In the prior art of hole openers, mills, reamers and stabilizers, there are patents which address the configuration and design of these types of tools. These patents include those listed below:

U.S. Pat. No 3,645,587 issued to Bill G. Parker entitled "Drill String Member and Method of Manufacture" shows a bottom hole stabilizer having three longitudinal, radially spaced apart blade members that are parallel to the central axis of the tool body with three annular flow zones which span the distance between the blade members. The tool shown by this invention is used to center a drill string in the bore hole in order to avoid deviation. This tool has upper and lower attachment means so that it can be placed above the bit in a drill string.

U.S. Pat. No. 3,147,536 issued to D. E. Lamphere entitled "Apparatus for Milling Tubular Strings in Well Bores" shows a mill used to grind debris in a hole and to remove tubular conduits, such as liners and casings. The apparatus has cutter blades placed around the circumference of the tool body and annular flow zones between the cutter blades. The lower portion of the cutter blades are designed to break away in the hole after a section of tubular conduit has been removed. The bull nose or pilot of the apparatus is short and wedge-shaped which make the tool difficult to use in soft formations and deviated wells since it can easily sidetrack.

U.S. Pat. No. 4,350,204 issued to Gary B. Horton, entitled "Reamer" is a device for removing paraffin, scale, ice and other accumulations from the inside services of oil well pump tubing and casing. The tool is run on a wireline and swivel joint and not on a drill string. While the tool does have an internal bore, the bore is not designed for the circulation of drilling fluids through it. Circulation of fluids is needed in order to rotary drill or to enlarge a bore hole. The apparatus has removable blades that are bolted to the tool body.

U.S. Pat. No. 3,114,416 issued to A. W. Kammerer entitled "Liner Hanger and Liner Milling Tool" shows a tool designed to run in a cased, rather than open hole. The tool body has multiple blade members spaced around its circumference with limited annular flow zones between the blade members. These design features make a tool susceptible to becoming balled-up in soft, unconsolidated formations. The tool has a short wedge-shaped pilot or bull nose designed for milling in a cased hole but which will cause sidetracking in an open hole since it will dig into the walls of soft formations.

U.S. Pat. No. 4,385,669 issued to Paul Knutsen entitled "Integral Blade Cylindrical Guage Stabilizer Reamer" is a tool designed to grind the circumference of the bore hole shortly after it has been cut by the drill bit. The tool helps to maintain the diameter of the bore hole as the drill bit passes through formations. The apparatus has blade members that spiral around the circumference of the tool body. The annular flow zones are limited so the tool is more useful in hard rock formations than in soft formations where balling up is a problem.

Russian Pat. No. 594,289 dated Feb., 1978 is very similar to the Knutsen patent. This apparatus is a bore hole guaging tool similar to a reamer. It has vanes which spiral around the tool body. Channels between the vanes are used to move cuttings up and out of the hole to keep the bottom of the hole clean. It does not have a pilot or bull nose since it is used in conjunction with a drill bit.

French Patent No. 1,407,504 issued Sept. 11, 1964 to The Birmingham Small Arms Company Limited appears to be a casing scraper, key seat wiper or packer. The apparatus does not have longitudinally extending blade members, a pilot, bull nose or circulation jets. Nor does it appear to have an internal bore for the passage of fluids.

U.S. Pat. No. 3,610,350 issued to Ed. O. Seabourn, on Oct. 5, 1971 is a rotary drill bit having chamber, annular and sidewall cutting elements for cutting an undersea wellhead and receiving the wellhead within the bit. The tool is not designed to be run on a drill string in a bore hole to enlarge the size of a bore hole. While it does have an internal bore and three longitudinal, radially spaced apart blade members that are parallel to the central axis of the tool body bore, it does not have a pilot or bull nose to guide the tool through an existing well bore.

GENERAL DISCUSSION OF THE PRESENT INVENTION

The present invention provides a drill string tool apparatus for enlarging the size of existing bore holes. The device includes an elongated body having a flow conveying longitudinal internal bore, a collar, a triangular midsection and pilot section each having a substantially triangular cross-sectional configuration and a bull nose having an outer diameter somewhat less than the inner diameter of the bore hole into which it is to be inserted. The tool body is affixed to a drill string by standard A.P.I. pin and box connections at its collar end.

Once the hole opener is attached to the drill string, the bull nose is the first part of the tool body to enter the bore hole. The bull nose has an outer diameter somewhat less than the inner diameter of the bore hole and is substantially rounded on its end opposite the collar end. The rounded end portion assists in guiding the apparatus through the existing bore hole. The bull nose can have a linear dimension equal to or greater than the linear dimension of the collar so that the tool will follow the existing hole without sidetracking or making a new hole. The bull nose has at its rounded end portion a port into which may be installed either a jet for the circulation of fluids through the bull nose into the bore hole or a plug to prevent the circulation of fluids through the bull nose when the tool is used in extremely soft formations where jetting may cause a sidetrack.

Immediately above the bull nose is the pilot section. The pilot section of the preferred embodiment of the present invention is similar in function and design to the midsection. The pilot and midsection both have three longitudinal, radially spaced apart blade members that are parallel to the central axis of the tool body bore. The blade members have a contact surface area defining an outer surface having the radial dimension limit of the tool body. The radial dimensions of the pilot section are somewhat less than the radial dimensions of the midsection. This design feature allows the diameter of the bore hole to be gradually increased as the tool body rotates on the drill string.

The blade members of the midsection have a longitudinally extending cutting edge placed along one side of the contact surface area. The cutting edge and the contact surface area on both the midsection and pilot section are treated with tungsten carbide to facilitate cutting. The cutting edge and the lower portion of the contact surface area of the midsection are treated with tungsten carbide chips. The upper portion of the contact surface area of the midsection is treated with tungsten carbide mesh to form a wear pad which smooths or dresses the wall of the enlarged bore hole. Tungsten carbide chips are affixed to the contact surface area of the pilot section so that an upset rib section is formed.

In the preferred embodiment of the present invention annular flow zones span the distance between the blade members of the pilot and the midsection. The annular flow zones allow for the circulation of fluids in the bore hole. The annular flow zones of the midsection have jet means for the circulation of fluids through the internal bore of the tool body into the bore hole. The annular flow zones of the triangular midsection converge with the blade members to define a channel adjacent and parallel to the blade members wherein the channel has a recess at its intersection of the blade members of the pilot and the midsection so that cuttings and fluid can be directed away from the blade members and up the length of the tool body as the size of the hole is enlarged.

The tool body has tapered transition zones between the collar and the midsection, between the midsection and the pilot, as well as between the pilot and the bull nose to aid the flow of cuttings and fluid along the external surface of the tool body. In the preferred embodiment of the present invention, the blade members and the bull nose are integral portions of the tool body. However, in some applications it may be desirable to have the bull nose affixed to the tool by means of standard A.P.I. connections in order that the bull nose can be removed so that the tool body can be run above a drill bit.

It is therefore an object of the preferred embodiment of the present invention to provide a new and improved hole opener having the blade members of integral construction with the tool body so that the blades will not fall off in the hole.

It is a further object of the preferred embodiment of the present invention to provide a hole opener wherein there are broad annular flow zones spaced between the blade members so that the tool will not become balled-up and lose its effectiveness in the hole.

It is a further object of the preferred embodiment of the present invention to provide a pilot positioned between the bull nose and the midsection having a smaller outer diameter than the midsection so that the size of the hole can be gradually increased as the drill string is rotated in the hole.

It is a further object of the preferred embodiment of the present invention to provide a hole opener wherein the annular flow zones of the triangular midsection converge with the blade members to define a channel adjacent and parallel to the blade members, wherein the channel has a recess at the intersection of the blade members of the pilot and the midsection so that cuttings and fluids can be directed away from the blade members and up the length of the tool body as the bore hole is enlarged.

It is a further object of the preferred embodiment of the present invention to provide a hole opener having an internal bore throughout its length so that fluids can be circulated through it into ports in the annular flow zones and the rounded end portion of the bull nose.

It is still a further object of the preferred embodiment of the present invention to provide a hole opener having a bull nose of sufficient linear dimensions to guide the tool body through the existing hole without causing the hole to sidetrack.

BRIEF DESCRIPTION OF THE DRAWINGS

For a further understanding of the nature and objects of the present invention, reference should be had to the following detailed description, taken in conjunction with the accompanying drawings in which like parts are given referenced numerals and wherein.

DETAILED DESCRIPTION OF THE PREFERRED EMBODIMENT

Figure 1:
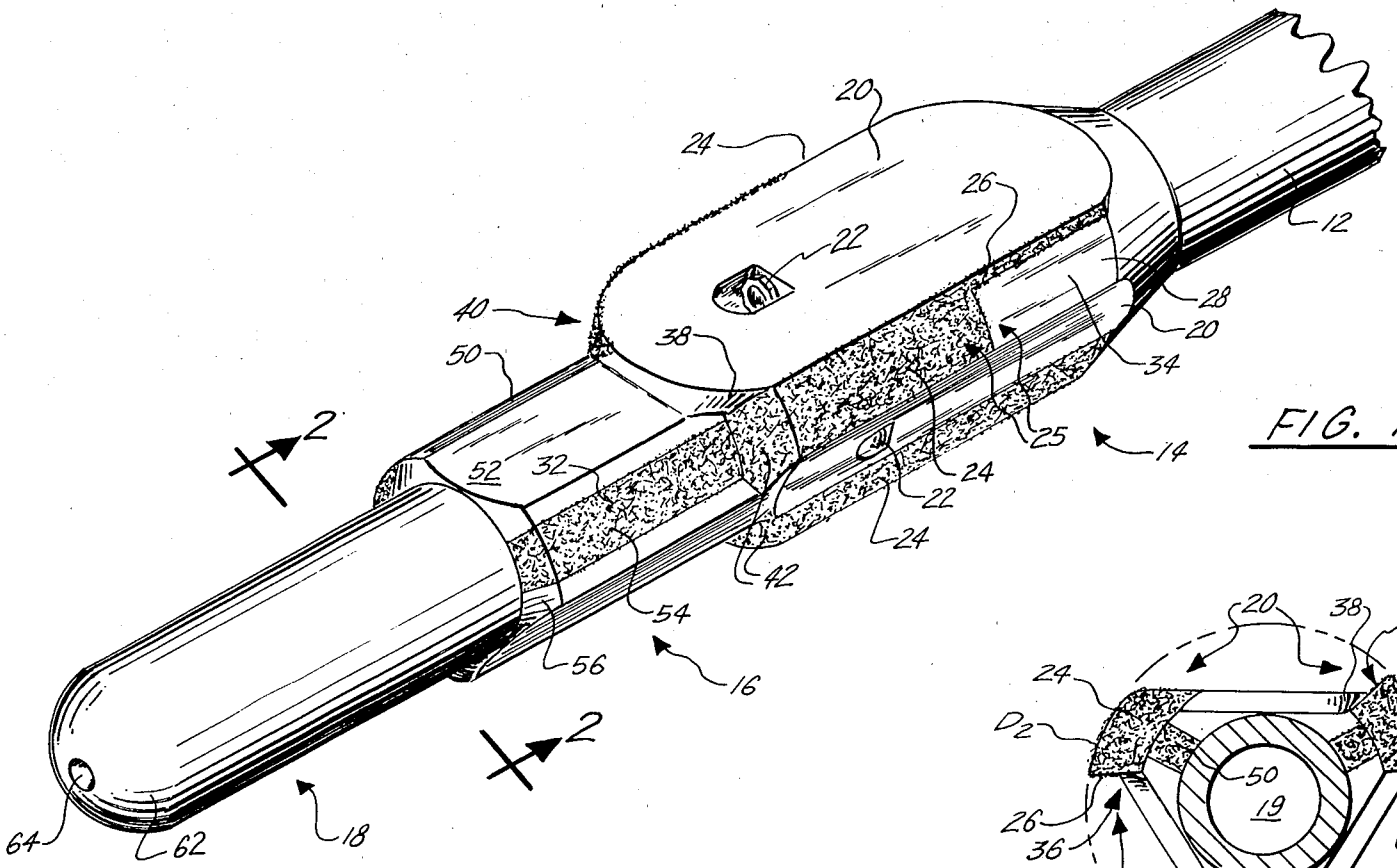
FIG. 1 is a perspective view of the preferred embodiment of the integral blade hole opener of the present invention.
Figure 2:
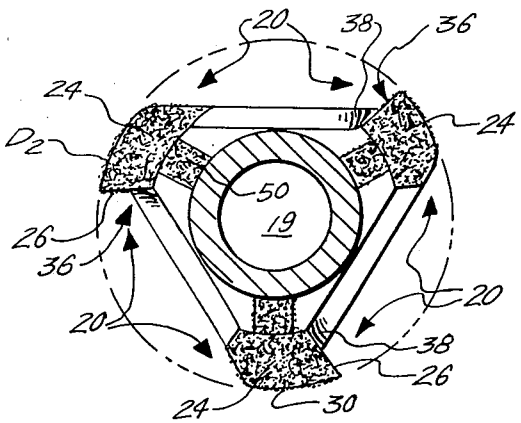
FIG. 2 is a sectional view taken along line 2—2 of FIG. 1.
Figure 3:
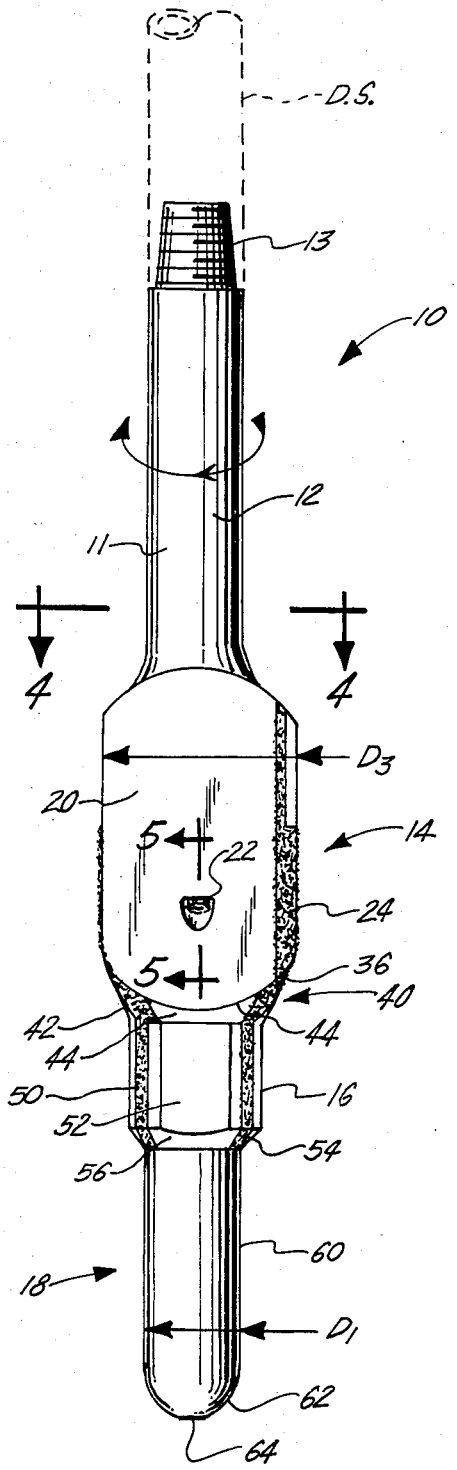
FIG. 3 is a side view of the integral blade hole opener of the present invention.

FIGS. 1 and 3 illustrate the preferred embodiment of the apparatus of the present invention designated by the numeral 10. In FIG. 1 there is illustrated a hole opener 10 having tool body 11. Tool body 11 comprises generally collar 12, triangular midsection 14, pilot 16, and bull nose 18. Tool body 11 is generally cylindrical, having a cylindrical internal bore 19 (FIG. 2).

Tool body 11 can be affixed to a drill string D.S. by standard A.P.I. pin connection 13 or the like. Internal cylindrical bore 19 extends longitudinally through tool body 11 and communicates with an internal bore of the drill string D.S.

Triangular midsection 14 is generally comprised of three radially spaced blades 24 having annular flow zones 20 spaced therebetween. Blades 24 are in a triangular configuration equally spaced apart from one another. The triangular midsection 14 has three (3) radially spaced jets 22 for the circulation of fluids through internal bore 19. Each jet 22 communicates with internal bore 19.

Each blade member 24 of midsection 14 has an outer peripheral contact surface area 25 defining an outer surface having the radial dimension limit of the tool body 12 during rotation of the drill string D.S. and including a longitudinally extending cutting edge 26 placed along one side of contact surface area 25. Contact surface area 25 has at its upper portion spaced apart from cutting edge 26 a generally rectangular wear pad 28 which in the preferred embodiment of the present invention is coated with tungsten carbide mesh 34. The remainder of contact surface area 25 and cutting edge 26 are coated with tungsten carbide chips 32.

FIG. 2 illustrates how annular flow zones 20 of triangular midsection 14 converge with blade members 24 to define channel 36 which is adjacent and parallel to blade members 24. Channel 36 has recess 38 at the intersection of blade members 24 and blade 50 of pilot 16 in order to direct cuttings and fluids away from blade members 24, 50.

Transition area 40 connects triangular midsection 14 and pilot 16. Transition area 40 has cutting surface 42 and annular flow zones 44. Cutting surface 42 communicates with blades 24, 50 while annular flow zones 44 communicate with annular flow zones 20, 52.

Pilot 16 has a substantially triangular configuration (FIG. 2) wherein blades 50 are equally and radially spaced apart one hundred twenty (120) degrees. Annular flow zones 52 span between blades 50. Blades 50 in the preferred embodiment of the present invention have a tungsten carbide chip coating 32 affixed in such a manner that tungsten carbide chips 32 form an upset rib section 54.

Transition area 56 defines the connection between pilot 16 and bull nose 18. Outer surface 60 of bull nose 18 is generally smooth. Tapered end 62 of bull nose 18 has at its end opposite pilot 16, circulation jet 64.

Figure 4:
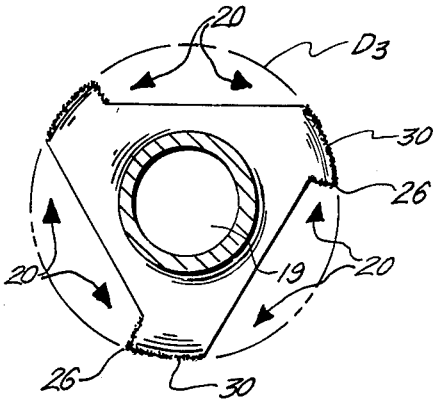
FIG. 4 is a sectional view taken along line 4—4 of FIG. 3.
Figure 5:
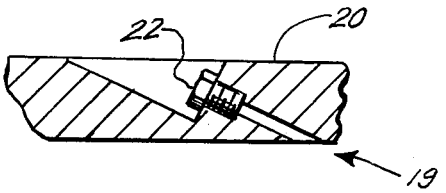
FIG. 5 is a fragmentary view of the preferred embodiment of the apparatus of the present invention illustrating the jetting nozzle portion thereof.

Note that bull nose 18 is generally cylindrical and of a generally uniform diameter $D_1$. Pilot 16 is of a slightly larger diameter $D_2$ than the diameter $D_1$ of bull nose 18. The diameter $D_2$ is defined as the diameter generated by a rotation of the pilot 16 section. Diameter $D_3$ is defined by the rotation of blades 24 (FIG. 4).

What is claimed as the invention is:

1. A drill string tool apparatus for enlarging the size of oil/gas holes comprising:

a. a tool body having at least a portion thereof with a generally triangular cross-sectional area that includes three radially spaced blades;

b. means for forming a removable connection between the tool body and a drill string;

c. the tool body having an open ended flow conveying longitudinal internal bore for circulating fluids between the tool body and a drill string connected thereto;

d. the body including a triangular midsection comprising:

i. three longitudinal, radially spaced apart midsection blade members that are parallel to the central axis of the tool body bore so that the blade members can cut into the walls of the bore hole to enlarge the size of the bore hole;

ii. three generally flat flow zone surfaces which span between the midsection blade members;

e. each said midsection blade member comprising:

i. a contact surface area means carried on the blade member for defining the radial dimensional limit of the tool body during a rotation of the tool body and a connected drill string;

ii. a longitudinally extending cutting edge positioned adjacent the contact surface area means;

f. pilot section means positioned on the tool body below the midsection and having a smaller outer diameter than the outer diameter of the midsection during rotation of the tool body, for gradually enlarging the size of the bore hole, comprising:

i. three longitudinal, radially spaced apart pilot section blade members that are parallel to the central axis of the tool body bore;

ii. three annular flow zone surfaces which span the distance between the pilot section blade members; and g. a lowermost, generally cylindrical bull nose tip portion of the tool body having a substantially rounded end portion for guiding the tool body through the bore hole.

2. The apparatus of claim 1 wherein both the midsection and pilot section blade members are an integral portion of the tool body.

3. The apparatus of claim 1 wherein the annular flow zone surfaces of the midsection have jet means for the circulation of fluids through the internal bore of the tool body into the bore hole.

4. The apparatus of claim 1 wherein the bull nose includes a port in its rounded end portion which is receptive of a jet for the circulation of fluids through the bull nose into the bore hole.

5. The apparatus of claim 1 wherein the annular flow zone surfaces of the triangular midsection and the midsection blade members define a channel adjacent and parallel to the blade members, wherein the channel has a recess at the intersection of the blade members of the pilot and midsection so that cuttings and fluids can be directed away from the blade members and up the length of the tool body as the size of the bore hole is enlarged.

6. The apparatus of claim 1 wherein the tool body includes an upper collar section above the triangular midsection and there are first tapered transition zone surfaces between the collar and the midsection, and second transition zone surfaces between the midsection and the pilot.

7. The apparatus of claim 1 wherein tungsten carbide chips are applied to the contact surface area means of the midsection blade members.

8. The apparatus of claim 7 wherein tungsten carbide chips are affixed to the outer surface of the pilot section blade members.

9. The apparatus of claim 1 wherein the midsection blade members and pilot section blade members each define rotational cross-sections and the midsection blade members define a rotational section having a larger diameter than the rotational section defined by the pilot section blade members.

10. The apparatus of claim 9 wherein the rotational cross-sectional of the pilot blade sections has a larger diameter than the diameter of the bull nose tip portion.

* * * * *